United States Patent [19]

Koblanski

[11] Patent Number: 4,669,972

[45] Date of Patent: Jun. 2, 1987

[54] METHOD OF REMOVING AN OIL SLICK BY ATOMIZING AND BURNING

[75] Inventor: John N. Koblanski, Burnaby, Canada

[73] Assignee: Ocean Ecology Ltd., Vancouver, Canada

[21] Appl. No.: 634,908

[22] Filed: Jul. 26, 1984

[51] Int. Cl.[4] ..... F23G 11/00

[52] U.S. Cl. ..... 431/2; 210/922; 210/923

[58] Field of Search ..... 431/2, 162, 163; 210/922, 923, 925, 748

[56] References Cited

U.S. PATENT DOCUMENTS 4,008,038 2/1977 Berthiaume ..... 431/2 X 4,308,006 12/1981 Koblanski ..... 431/2 X

*Primary Examiner*—Randall L. Green

*Attorney, Agent, or Firm*—Townsend and Townsend

[57] ABSTRACT

A device to combust an oil slick floating on a body of water. The device comprises a hood and a container to receive oil and water. A jet forces oil from the surface into the container. There is a combustion chamber with an atomizing nozzle in the combustion chamber. A conduit communicates the container and the atomizing nozzle. Fluid of high velocity is supplied to the atomizing nozzle and a source of combustible gas can be fed to the combustion chamber along with air to support combustion.

34 Claims, 12 Drawing Figures

54
160
26
164
162
36
34
2
4
125
2
168
166
124
122
120
24a
123
123

22
16
66
18
20
51
53
64
99
105
55
25
57
60
46
47
62
24
6
8
2
48
86
2
10
14
26
82
4
30
32
84
90
94
14
14
42
12
44
88
58
50
26
56
40
92
54
52
36
34
28
26
38
103
101

METHOD OF REMOVING AN OIL SLICK BY ATOMIZING AND BURNING

FIELD OF THE INVENTION

This invention relates to a device for the combustion of oil in the form of a slick on the surface of open water or one which has sunk below that surface.

DESCRIPTION OF THE PRIOR ART

Oil spills are increasingly common and, especially with the huge capacity of modern oil tankers, disastrous occurrences. When a modern tanker runs aground and breaks huge quantities of oil can be released in the sea. However even accidental leakage of relatively small quantities of oil can leave slicks of appreciable size. The usual result is an environmental hazard affecting fish and sea birds as well as wild life living on the shore. Although several methods have been tried for containing and removing the slicks these have proved relatively costly and ineffective. Furthermore, other than the method presented here, there exists no known means for removal of a sunken oil slick. Also, no present methods have been able to combust highly emulsified oil slicks. The method outlined here will combust a 50% emulsion of water and oil. The present known methods include the use of containing the slick by a large number of booms and its removal through application of oil absorbing pads and detergents.

SUMMARY OF THE INVENTION

The present invention seeks to provide equipment that is small, manouverable and can be transported to the site of an oil slick shortly after its release. In this way the oil slick can be removed more easily. In this regard it is particularly important to get to an oil slick as soon as possible after the slick has been laid down as at that time the volatile content of the slick is high, thus assisting in combustion.

However if an oil slick has sunk because of an increase in density with time or because of exposure to sun and winds or because of its initially high specific gravity, means is here provided to lift it to the surface.

Accordingly, the present invention is a device to combust an oil slick floating on a body of water, the device comprising a hood; a container raised above the water level to receive oil and water; a jet to force mainly oil from the surface into the container or containment ring; a combustion chamber; an atomizing gas transducer in the combustion chamber; means communicating the container and the atomizing gas transducer; means to supply air or steam under pressure to the atomizing transducer; a source of combustible gas communicating with the combustion chamber; and means to provide air to the combustion chamber.

The invention also enables floating a sunken oil slick by providing a fine particle mist of oil and air to be injected below the sunken slick to increase its buoyancy sufficiently to allow it to surface.

The present invention may be either mounted on an independently movable vessel or may be adapted to be towed by two other vessels in situations where a large boom is required.

DRAWINGS

Aspects of the invention are illustrated, merely by way of example, in the accompanying drawings in which:

FIG. 1 is a plan view illustrating generally the use of the present invention in removing an oil slick;

FIG. 1*a* is a plan view of the means to transport apparatus for lifting a sunken oil slick or removing dangerous dissolved toxins;

FIG. 1*b* is a schematic view showing the means of producing and injecting an oil air mixture below the sunken oil or contaminant dissolved within the water;

FIG. 2 is a schematic view illustrating the main components of the device of the present invention;

FIG. 2*a* is a schematic view illustrating an alternative placement for the container receiving the levitated oil;

FIG. 2*b* is a schematic view illustrating an alternative mounting method resulting from the use of a flexible hose fuel intake allowed to float independently of the main body;

FIG. 2*c* is a schematic view illustrating the annular type of levitating jet;

FIG. 2*d* is a schematic view illustrating a method of concentrating the oil using a rectangular jet;

FIG. 2*e* is a plan view of the apparatus shown in FIG. 2*d;*

DESCRIPTION OF THE PREFERRED EMBODIMENTS

Figure 1:
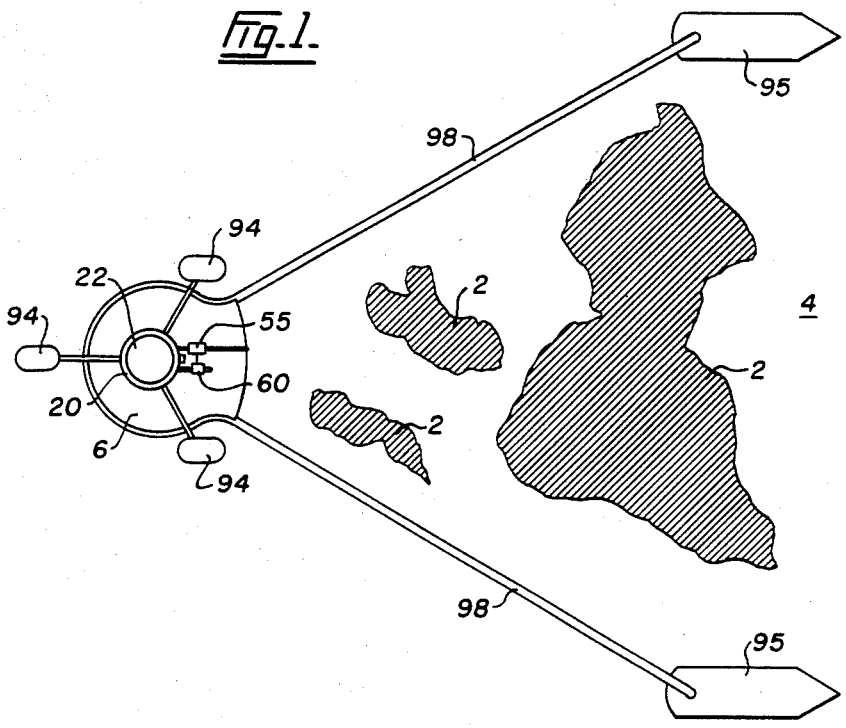
Figure 1A:
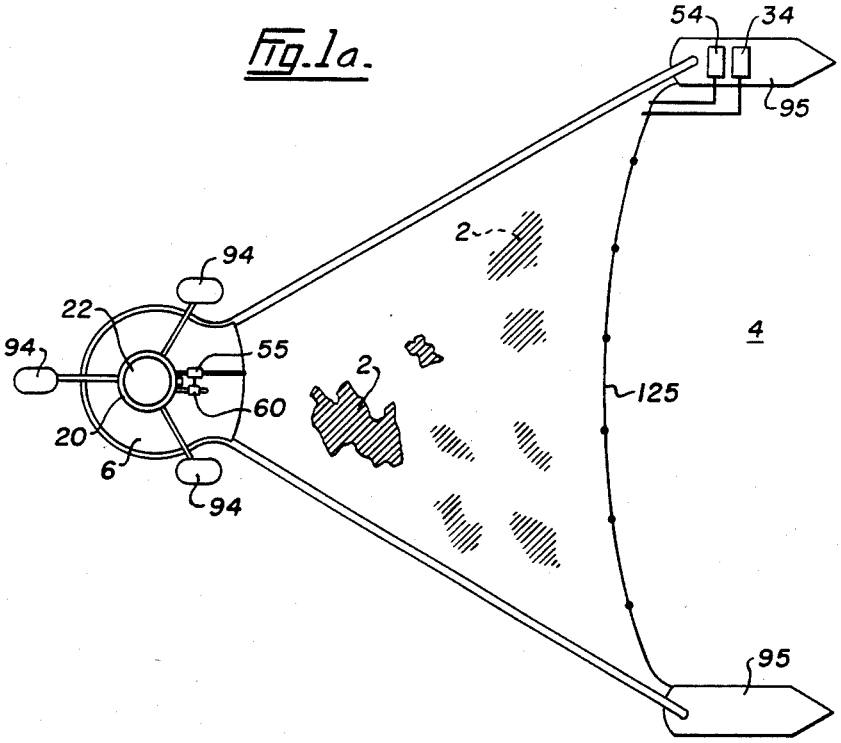
Figure 1B:
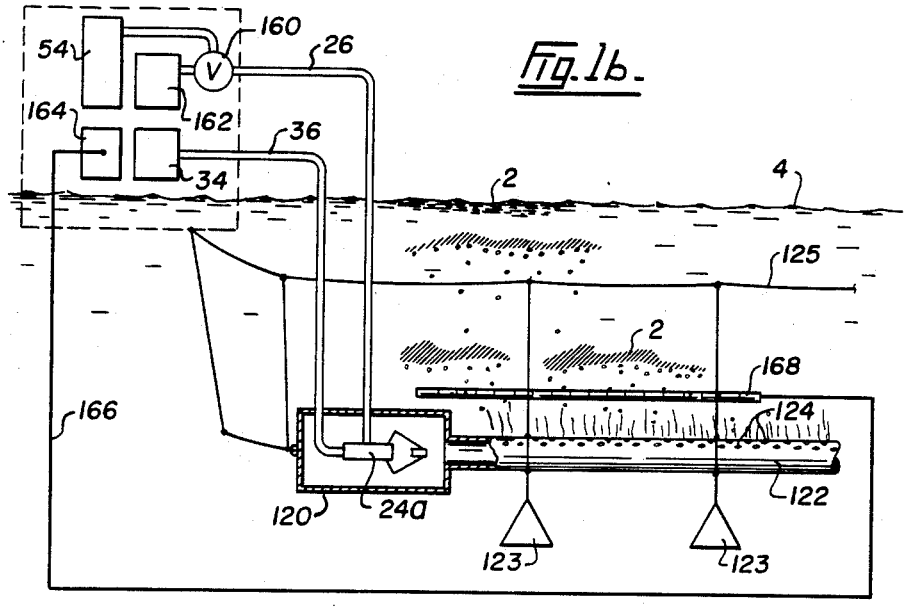
Figure 2:
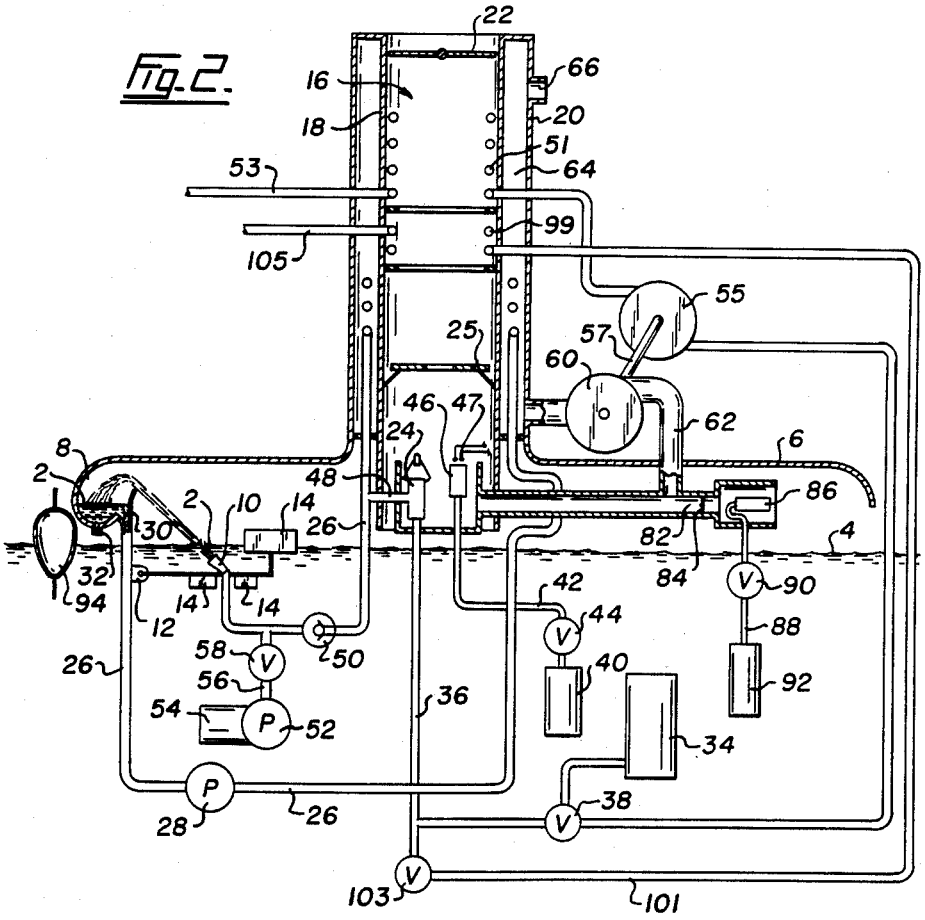

The drawings illustrate a device to combust an oil slick 2 floating on a body of water 4. Referring particularly to FIGS. 1 and 2 the device comprises a hood 6 and a container 8, the container 8 being raised above the water level to receive oil and water. There is a jet 10 to force oil from the surface into the container 8. The jet 10 is annular and may be of rectangular or circular cross section and is positioned by being hingedly mounted at 12 and by the provision of floats 14. This mounting permits the variation of the position of the jet 10 below the water thus ensuring the correct depth for proper operation is maintained.

There is a combustion chamber 16 which, as shown in FIG. 2, comprises a central stack 18 having an outer shell 20. There is a flap valve 22 positioned at the top to control the temperature within the chamber 16; opening it reduces the temperature. There is an atomizing transducer 24 in the combustion chamber 16 which is a sonic stem-jet atomizer. Although a stem-jet atomizer is shown as an example it will be appreciated that other types of atomizers may be incorporated.

An annular ring 25 is suspended from the walls of the combustion chamber and serves to redirect the unburned gases downward to assure complete combustion and to direct hot gases beneath the hood through the lower end of stack 18.

The atomizer transducer receives oil and some water from the container 8 through conduit 26. The oil is driven along conduit 26 by pump 28. In this regard the container 8, which receives oil and water through the open top from the jet, has an outlet 30 in its top so that oil may enter the conduit 26 and an outlet 32 at its base so that water may return to the body of water 4.

There is a supply of compressed air 34 to the atomizing transducer 24. The air impinges on the resonator of the transducer causing a shock wave to be generated atomizing the oil. The compressed air is fed through conduit 36, controlled by valve 38 to the transducer 24.

There is a source of combustible gas, for example propane, contained in container 40. The gas passes through conduit 42 controlled by valve 44 to a burner jet 46.

It is desirable to provide a means to preheat the oil and to this effect, as indicated in FIG. 2, the conduit 26 passes through passageway 64 between wall of the stack 18 above the burner jet 46 having an associated spark igniter 47 with its own high voltage supply (not shown). A portion of the oil, suitably heated, is then passed to the atomizing transducer through branch conduit 48. The rest passes through the conduit 26 back to the jet 10 through check valve 50.

To further increase the efficiency of the method, means is provided to generate steam from the heat resulting in the combustion of the oil. Coils 51 (FIG. 2) for this purpose are placed within the stack and inlet 53 allows sea water to enter. The sea water is changed to steam and drives turbine 55. This is coupled by drive shaft 57 to drive fan 60. The steam generated may also be used (instead of compressed air) to create the required shock wave within the resonator of the stem-jet transducer. A further benefit of producing steam is better control of stack temperatures, thus eliminating the need for exotic metals to withstand temperatures above 2000° F.

There is a pump 52 and a solvent container 54 communicating through conduit 56 containing valve 58 with conduit 26.

Combustion air is provided to the combustion chamber 16 by the use of high volume fan 60 feeding air through conduit 62. The fan 60 draws air through an outer passageway 64 formed around the combustion chamber 16 and having an inlet 66. In this manner the fan 60 feeds warm air to the combustion chamber 16.

As a means of warming the temperature of the air, and thus of the oil slick, under the hood 6 a bypass 82 is provided on the outlet side of fan 60. The bypass 82 is controlled by butterfly valve 84. At the outlet of the bypass 82 there is a burner jet 86 supplied by conduit 88 through valve 90. A source of combustible gas, again for example propane, is stored at 92.

As shown particularly in FIGS. 1 and 2 the device may be stabilized by the use of floats 94. Furthermore the device may be towed by towing vessels 95 by lines 98. Electrical power supply may be passed through the line 98 from the towing vessels 95.

In use the device is brought to the vicinity of an oil slick 2. It may be towed or self-propelled as discussed later. Flap valve 22 is closed to seal combustion chamber 16. Flap valve 84 is opened. Valves 44 and 90 are opened to allow propane to communicate with the jets 46 and 86. The propane is ignited by a spark. The hot air resulting from the combustion of the propane is directed under the hood 6 where it is trapped. The high volume fan 60 is started and draws fresh air through the inlet 66 through passageway 64 surrounding the combustion chamber 16 and into the combustion chamber and to the propane burner 46. Because it is drawn past the combustion chamber 16 the air is heated before being directed under the hood and to the jets 46 and 86. The trapped hot air heats the underlying oil slick and thus improves its fluidity. If necessary the solvent pump 52 is started, valve 58 is opened, and solvent is forced through the jet 10 to lift oil from the water. The cross sectional outlet of the jet is typically an annular rectangle or circle—see FIG. 2*c*—and it is a feature of the present invention that it shows for the first time that oil can best transfer momentum to oil and thus elevate it higher, with less water and no emulsification. After an initial injection of the solvent by jet 10 the oil slick itself is used as the cleansing means and the valve 58 may be closed and the pump 52 switched off. Conduit 26 has a flexible portion near jet 10 and this, together with the hinged mount 12 and the use of floats 14, permits positioning of the jet 10 at an appropriate level beneath the surface. Valve 38 is opened and compressed air or steam provided to transducer 24.

In the container 8 oil is skimmed from the top to enter conduit 30 and water passes through outlet 32. To ensure that only water returns through the outlet 32 the rate of inflow and rate of outflow of the oil down the conduit 26 are used to determine an ideal nozzle diameter. Oil pump 28 delivers the collected oil and solvent through conduit 26, to the transducer 24. The transducer 24 atomizes the oil to form an extremely fine mist. The mist is combusted by the flame issuing from burner jet 46. Jets 46 and 86 of burning propane may be turned off once the combustion is underway. Small flap valve 84 may be closed as the necessary heat for the oil is now provided by the heat of the combustion chamber 16. This is further controlled by opening or closing damper 22. As indicated the solvent pump 52 can be turned off and the valve 58 closed unless the oil is heavily weathered in which case it may be necessary to use the solvent continuously.

The device is towed back and forth through the oil slick 2 until all the oil is combusted.

While burning oil, any hazardous chemical contaminant in or with the oil may also be disposed of by pumping it through coils 99 via port 105 (FIG. 2) where it is vaporized and conducted by conduit 101 and valve 103 to be used as a source of compressed gas for the resonator of the stem-jet transducer. Thus both the oil and toxic contaminant may be eliminated together.

Figure 2A:
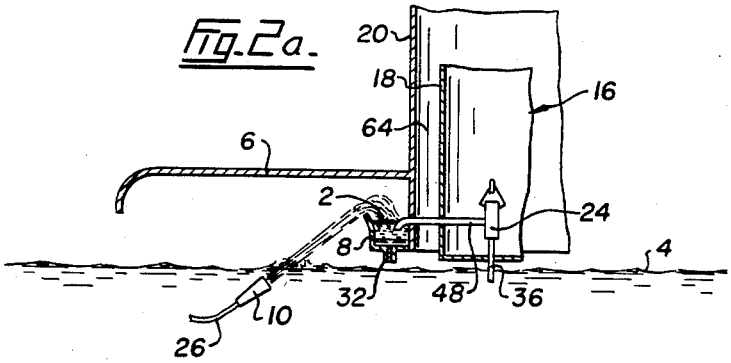
Figure 2B:
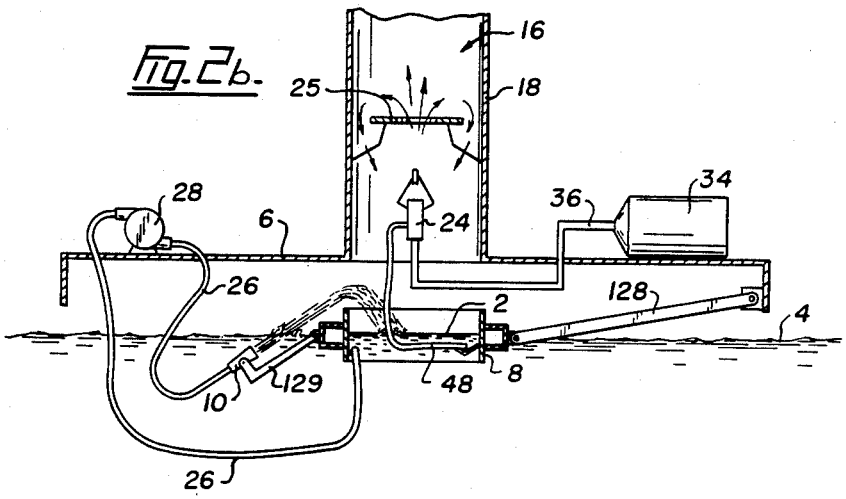
Figure 2C:
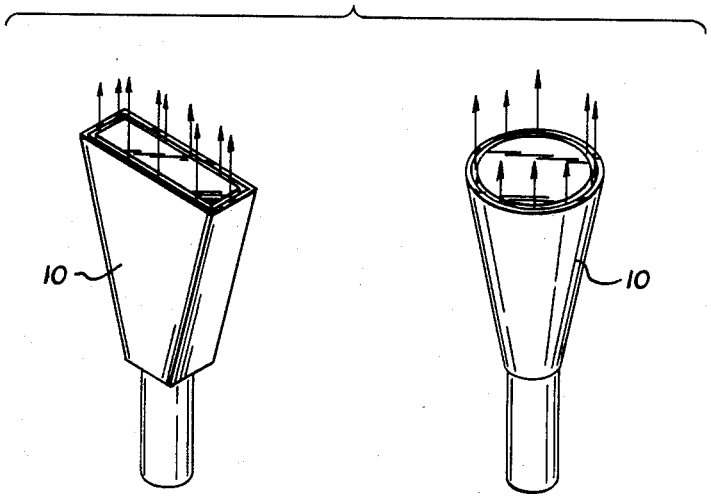
Figure 2D:
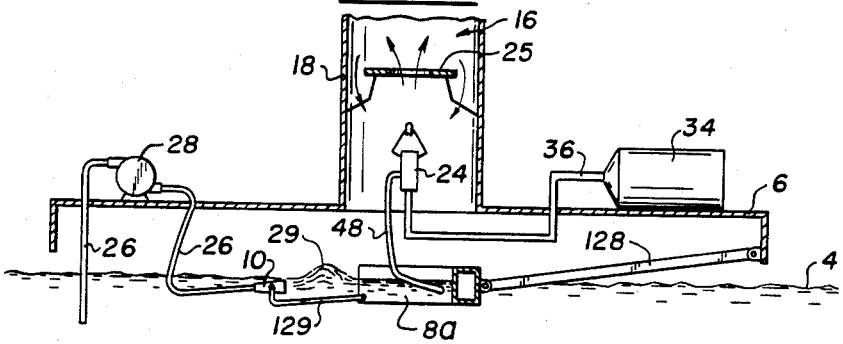
Figure 2E:
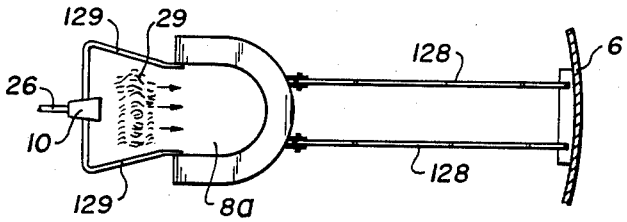

Further embodiments of the invention are illustrated in FIGS. 2*a* and 2*b*. FIG. 2*a* depicts a sectioned view of an apparatus essentially the same as that disclosed with the exception that nozzle 10 levitates oil into container 8 which is secured directly to the shell 20 of stack 18. Conduit 26 is thus greatly shortened and lacks the spiral portion which surrounds stack 18. This embodiment is for use with small confined slicks as all the oil removed by nozzle 10 and deposited in container 8 is burned in the combustion chamber. Accordingly only solvent issues from nozzle 10. The spiral portion of conduit 26 is removed as the need for heating of the oil is much reduced since the container 8 abuts and receives radiated heat. Otherwise the apparatus is operationally and structurally identical to that previously disclosed.

FIG. 2*b* illustrates a further embodiment of the invention which makes the device suitable for operation by a single person. Container 8 is suspended from floats (not shown) directly beneath stack 18 and is pivotally mounted to arm 128 which is in turn secured to hood 6. In this instance conduit 26 comprises a flexible portion extending from container 8 to the pump 28, and a flexible portion extending from the pump to the nozzle 10. Conduit 48 extends from the container to the transducer 24. Conduit 48 is highly flexible and is attached to container 8 to float with it. Nozzle 10 is pivotally mounted to container 8 by means of arm 129. Again, the spiral portion of conduit 26 is omitted as the container 8 is sufficiently close to combustion chamber 16 to receive radiated heat.

The attachment of the jet 24 by a flexible pipe 48 reduces the inertia of the system. The arrangement ensures that the jet 24 does not have to follow the wave motion which means it can operate in rough seas. In the FIGS. *2d* and *2e* embodiment sea water is drawn through intake pipe 26 and delivered by pump 28 to the rectangular jet 10 (shown in FIG. *2c*). This jet is disposed almost horizontally so as to direct the oil slick forward but inclined sufficiently upward to create a mound 29 of water and oil at the entrance of a modified horseshoe-shaped container 8*a*. Jet 10 is preferably pivotally mounted to this container 8*a* by arms 129. The operation of this jet differs from the aforementioned levitating jet in that sea water and not oil is used for imparting a forward momentum to the slick. An advantage of this embodiment is that the depth of this jet is less critical than that of the levitating jet of FIGS. *2a* and *2b* and thus may be fixed if so desired. Regardless of whether it is rigidly secured to the container or not, the nozzle serves to effectively "sweep" a surface face of an oil slick. The advantages of this type of jet in comparison to those conventional types which direct water downwardly are that the oil slick is not driven below the surface, no water-oil emulsion is formed, and there is no aeration of the emulsion. The latter can cause a decrease in fluidity and therefore a problem in pumping or handling the collected oil slick. The rectangular shape of the jet results in laminar rather than turbulent flow, thus greatly increasing the rate of herding of the slick. It also enables the formation of a stable mound 29 (FIGS. *2d* and *2e*) of water which acts as a barrier to prevent the accumulated oil from escaping from the confined area formed between the walls of container 8*a* and the mound of water. Containment results in sufficient thickening of the oil layer to allow the floating branch conduit 48 to remove mostly oil. The thickened oil also results in less thermal loss to the underlying water since thick oil acts as an insulator and thus aids in maintaining a high under hood temperature. The structure and operation of this device is otherwise identical to that illustrated in FIG. *2b*.

An apparatus for floating a submerged oil slick is also provided (see FIG. *1b*). Parts common to figures discussed above have the same reference numerals as in those Figures. A stem-jet 24*a* is placed in a sealed compartment 120 below the oil slick 2. The compartment 120 is contiguous with a tube 122 having a plurality of holes or outlets 124. The compartment 120 and tube 122 are held in position below the water's surface by weights 123 and towline 125. Compressed air from supply 34, oil and solvent from container 54 are supplied to the stem-jet 24*a* resulting in removal of any sea water within the compartment. A shock wave is set up in the resonating of the stem-jet transducer. A very fine mist of oil and air is produced. This is fed through the system of holes and is released into the water below the sunken oil slick. This fine distribution of oil and air attaches to the sunken slick resulting in its movement to the surface. The solvent and very light oil result in an increase of the oil slicks fluidity at the surface. This apparatus is towed as shown in FIG. *1a*.

When all the oil slick has risen the procedure for burning is the same as for an oil slick found originally on the surface. In the event that the sunken slick is a very great distance from the surface, which might result in static pressures too high for compressed air, then a mechanical emulsifier (not shown) using light oil and water may be employed. The oil and water mixture replaces the compressed air of the aforementioned method while the apparatus operates in an identical manner. The light oil can be relatively harmless vegetable oil, for example.

The same procedure is used to remove toxins such as D.D.T. The oil absorbs D.D.T. about 1000 times more readily than water and will thus cause it to leave the latter after exposure to oil which is distributed within it. Since emulsified oil and water take a while to surface this process is speeded up by a demulsification process. A suitable demulsifier is injected through conduit 26 and ejected as a fine spray through 24*a*. To allow this valve 160 controls a supply of demulsifier from a container 162 to feed into conduit 26. The apparatus of FIG. *1b* also has a power amplifier 164 connected by line 166 to a row 168 of sonic transducers, for example ceramic or magnetostrictive transducers.

As the demulsifier spreads the row 168 of sonic transducers are activated by power amplifier 164. The sonic energy created is beamed upwards causing not only the demulsifier to increase its activity but also in absorption of the D.D.T. resulting in a rapid surface layer formation of D.D.T. (or other toxin) which can then be burned as described.

Figure 3:
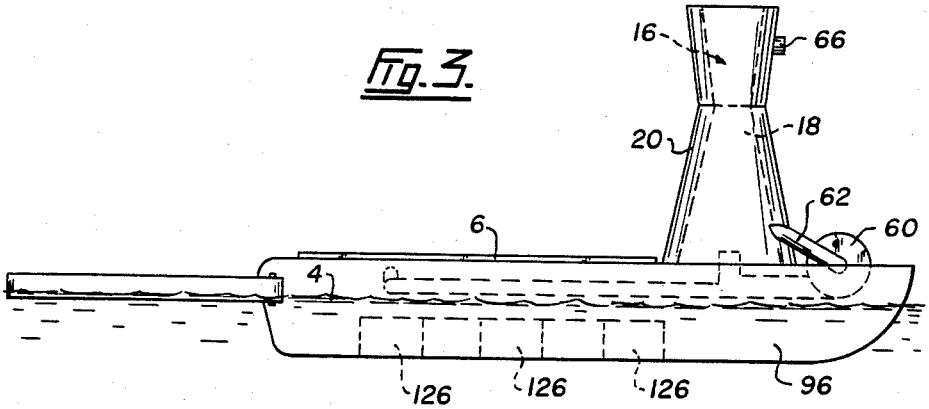
FIG. 3 is a side elevation of the device mounted on a hull.
Figure 4:
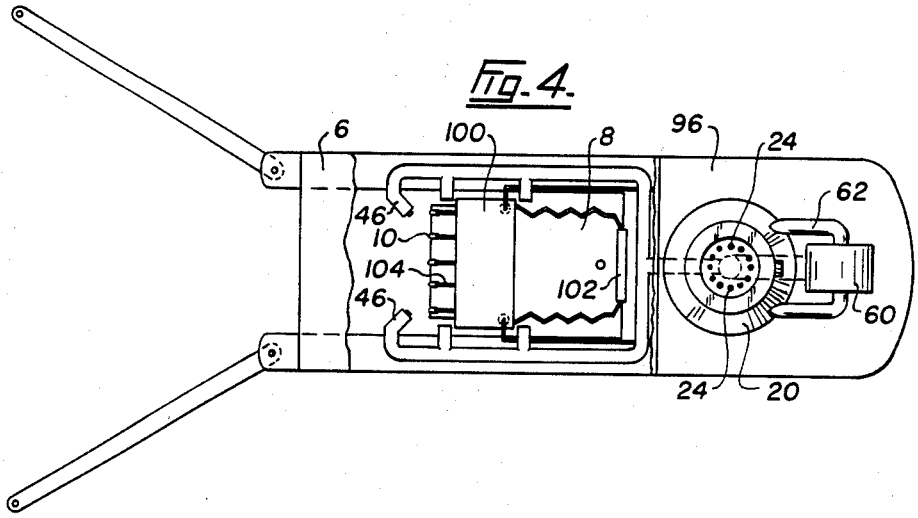
FIG. 4 is a plan view, partially in section, of the embodiment of FIG. 3.

Referring to the remaining Figures, the vessel of FIGS. 3 and 4 has a hull 96 but otherwise has the features shown in FIG. 2. In addition the device may desirably use a plurality of atomizing transducers 24 as shown particularly in FIG. 4. As shown particularly in FIG. 3 the control valves 38, 44, 58, 90 and the like, propane supply for jets 46, and 86, oil pump 28 and the control valves may be positioned in the hull 96 in compartments 126.

The device, as shown particularly in FIG. 4, also features a plurality of jets 10 to force oil from the surface to container 8. Burner jets 46 are also provided in the area adjacent jets 10 to provide heat and thus reduce the viscosity of the oil.

Figure 5:
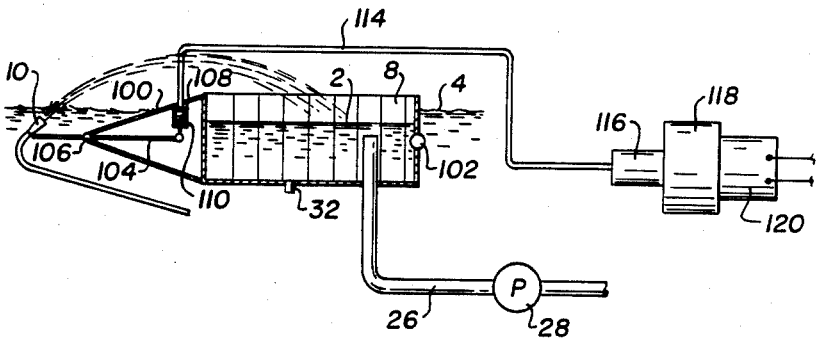
FIG. 5 illustrates a detail useful on the embodiment of FIGS. 3 and 4.

The jets 10 are mounted on a boom or fin 100 so that they may be pivoted to govern their position relative to the water surface. The mechanism is hingedly attached at 102 and, as shown particularly in FIG. 5, each jet is mounted on a rigid rod 104. The rod pivots at 106 and a distal end of the rod is attached to piston 108 within cylinder 110. Hydraulic fluid enters the other end of the cylinder 110 through conduit 114 communicating with master cylinder 116. Hydraulic fluid is driven from the master cylinder 116 by motor 118. Whether to drive fluid is determined by computer 120, shown schematically but designed to sense the speed of the hull 96 relative to the water and to send the appropriate signal to the motor 118. The motor 118 speeds or slows, as required, thus varying the supply of hydraulic fluid from the master cylinder 116 to the cylinder 110. In this way the piston 108 is moved in the cylinder 110 to move rod 104 to vary the depth of the jet 10.

The present invention thus provides a simple craft that can be used to burn large quantities of oil quickly. By use of the atomizing transducer the oil is provided as a fine spray which can be easily ignited by the combustion means described. It should be noted that the oil slick itself is used for its own removal. The discovery that oil can best transfer momentum to oil and thus lift it at a very high velocity is a particular feature of the present invention. The use of oil to lift oil above its surface enables the use of jets that are rectangular in shape and yet maintain lifting power. This rectangular jet is ideal for lifting large volumes of oil in very thin oil slicks. In addition, the annular design of the levitating jet enables performance in oil which has very little fluidity. A further result of this new type of jet is that highly aerated liquid (froth) may be easily levitated, improving the separation process in mining and bitumin extraction processes.

I claim:

1. A device to combust an oil slick floating on a body of water, the device comprising:

a hood to enclose at least part of the oil slick and to trap hot gases above the oil slick;

a container to receive oil and water within the hood;

a jet to force oil from within the hood into the container;

a combustion chamber to combust oil within the hood and communicating with the hood to allow hot gases to pass from the combustion chamber to beneath the hood;

ignition means in the combustion chamber to assist in starting combustion;

an atomizing nozzle in the combustion chamber;

means communicating the container and the atomizing nozzle for passing oil collected in the container;

means to supply fluid of high velocity to the atomizing nozzle;

a source of combustible gas communicating with the combustion chamber; and means to provide air to the combustion chamber.

2. A device as claimed in claim 1 in which the container is adapted to separate the oil and water.

3. A device as claimed in claim 1 in which the container is formed at the periphery of the hood.

4. A device as claimed in claim 1 in which the container has an open top to receive oil and water;

an outlet from the container for oil which is connected to the communication means;

an outlet in the bottom of the container to allow water to pass back to the body of water.

5. A device as claimed in claim 1 in which the jet comprises a body tapering outwardly and upwardly;

an opening adjacent the periphery of the upper face of the jet to allow oil to pass.

6. A device as claimed in claim 5 in which the jet is of generally rectangular or circular cross-section.

7. A device as claimed in claim 1 in which the jet forces the oil by pumping sea water against the oil.

8. A device as claimed in claim 7 in which the sea water is admitted through a floating inlet pipe.

9. A device as claimed in claim 8 in which the container is open on one side;

the jet being positioned to force the oil and sea water on a path just less than 180° to the container whereby a wave of water is formed that acts to keep the oil within the container.

10. A device as claimed in claim 1 including means to provide the jet with warmed oil, to force the surface oil to the container.

11. A device as claimed in claim 10 including a valve in the conduit to control flow.

12. A device as claimed in claim 11 including a solvent container and pump so that, at least initially, solvent may be pumped to the jet to facilitate oil removal.

13. A device as claimed in claim 1 including floats to control the position of the jet relative to the surface.

14. A device as claimed in claim 1 in which the means communicating the container and the atomizing nozzle comprises a conduit that passes from the container to the atomizing jet and including a bypass so that part of the oil may be fed back to the jet, through the water and back to the container.

15. A device as claimed in claim 1 in which the means communicating the container and the atomizing nozzle is a highly flexible hose, attached to the container.

16. A device as claimed in claim 1 including a fuel supply, a nozzle in the combustion chamber to receive fuel from the fuel supply, and wherein said ignition means comprises sparking equipment to ignite the fuel as the means to assist in starting combustion.

17. A device as claimed in claim 1 in which the atomizing nozzle is a sonic jet.

18. A device as claimed in claim 1 in which a second atomizing jet is located in a compartment able to be sunk beneath a sunken oil slick;

a supply of compressed air communicating with the compartment;

a supply of oil from the container communicating with the compartment;

a tube extending from the compartment;

a plurality of openings in the tube whereby a fine mist of oil and air generated by the second jet from the oil and air from said supplies, can be released through the openings to render the slick buoyant.

19. A device as claimed in claim 18 further including sonic transducers arranged above the tube;

means to activate the transducers to assist in lifting the slick.

20. A device as claimed in claim 1 in which means communicating the container and the atomizing nozzle is a conduit, the conduit passing around the walls of the combustion chamber before the atomizing nozzle to permit prewarming of the oil.

21. A device as claimed in claim 20 in which the conduit has a pump to assist the flow.

22. A device as claimed in claim 1 in which the means to supply fluid of high velocity to the atomizing nozzle is a source of compressed air.

23. A device as claimed in claim 1 in which the means to supply fluid of high velocity to the atomizing nozzle is a source of steam.

24. A device as claimed in claim 1 in which the source of combustible gas is a container of propane having an outlet jet in the combustion chamber.

25. A device as claimed in claim 1 in which the means to provide air comprises a high volume fan;

a duct communicating the fan with the combustion chamber.

26. A device as claimed in claim 25 including a bypass to direct air under the hood;

a valve controlling feed of air to the bypass;

a source of combustible gas in the bypass whereby the combustion gas can be burned to warm the air under the hood and thus the oil slick.

27. A device as claimed in claim 25 including means to generate steam using heat developed within the combustion chamber;

a turbine to be driven by steam;

a drive shaft from the turbine to the fan.

28. A device as claimed in claim 27 in which steam is taken from the turbine to the atomizing nozzle.

29. A device as claimed in claim 1 including a plurality of atomizing jets in the combustion chamber.

30. A device as claimed in claim 1 including a hull to float the device in the water.

31. A device as claimed in claim 30 having a plurality of jets to force oil from the surface to the container.

32. A device as claimed in claim 1 in which the jets are pivotally mounted on a boom;

means to control the position of the jets relative to the surface.

33. A device as claimed in claim 32 in which each jet is mounted on a rigid rod;

a piston at the distal end of the rod;

a cylinder to receive the piston;

means to sense the speed of the device in the water;

a motor;

a hydraulic piston movable by the motor depending upon said speed to move the piston in the cylinder to pivot the jets.

34. A device as claimed in claim 33 in which the means to sense the speed of the device is a computer able to receive the speed information to send a corresponding signal to the motor.

* * * * *